United States Patent [19]

Moss

[11] Patent Number: 4,592,509

[45] Date of Patent: Jun. 3, 1986

[54] BLOWING NOZZLE FOR SILENT OUTFLOW OF GAS

[76] Inventor: Hans Moss, Blåsvädersg. 6, Göteborg, Sweden, 417 32

[21] Appl. No.: 530,595

[22] PCT Filed: Nov. 17, 1982

[86] PCT No.: PCT/SE82/00388

§ 371 Date: Jul. 6, 1983

§ 102(e) Date: Jul. 6, 1983

[87] PCT Pub. No.: WO83/01747

PCT Pub. Date: May 26, 1983

[30] Foreign Application Priority Data

Nov. 18, 1981 [SE] Sweden ..... 8106856

[51] Int. Cl.[4] ..... B05B 7/06

[52] U.S. Cl. ..... 239/424; 239/425.5

[58] Field of Search ..... 239/DIG. 22, DIG. 21, 239/DIG. 7, 290, 434.5, 423, 424, 429.5, 417, 433, 288.5, 425.5

[56] References Cited

U.S. PATENT DOCUMENTS 3,477,112 11/1969 Yerkins ..... 239/424.5
3,615,053 10/1971 Pease et al. ..... 239/417
3,770,204 11/1973 Schuster ..... 239/288.5
4,195,780 4/1980 Inglis ..... 239/73
4,311,404 1/1982 Kodera ..... 239/288.5

*Primary Examiner*—Andres Kashnikow
*Assistant Examiner*—Scott Malpede
*Attorney, Agent, or Firm*—Holman & Stern

[57] ABSTRACT

A blowing device for compressed air or the like comprising at least one supply channel (15) which is connectable to a source of compressed air and outlet (19) which is shaped to impart to the compressed air a jet in the form of a ring or part of a ring, and at least one communication channel (20) adapted to connect the inside of the jet with the atmosphere. The object of the invention is to provide a blow nozzle with a large contact surface between outflowing pressurized air and the ambient air in order to provide an airflow with a low sound level, a large momentum, high efficiency and reduce striking velocity against the object intended to be cooled, dried or blown clean. This has been attained in that the product of the ratio between the outer plus the inner circumference ($O_2$ and $O_1$) of the outlet (19) and its area ($A_{out}$) and, on the other hand the inner diameter (D) of the outlet and its width (S), is at least 4 mm/mm$^2$, preferably considerably larger than 4 mm/mm$^2$.

18 Claims, 11 Drawing Figures

BLOWING NOZZLE FOR SILENT OUTFLOW OF GAS

The invention of this application is disclosed in International Application PCT/SE No. 82/00388, filed Nov. 17, 1982, in which applicant claims priority under 35 USC 119.

BACKGROUND OF THE INVENTION

1. Field of the Invention

The present invention relates to a blowing device for compressed air or the like having at least one feed channel which is connectable to a source of compressed air and an outlet which is shaped to impart to the compressed air a jet in the form of a ring, or part of a ring, under adiabatic expansion, and at least one communication channel adapted to connect the inside of the jet with the atmosphere.

2. Description of the Prior Art

The most common way to use compressed air for blowing purposes is by supplying the compressed air to a nozzle with one or several substantially circular outlet channels. The velocity of the discharge of the air is dependent upon the pressure upstream of the outlet channels and the pressure situation downstream of the same. If this pressure relation corresponds with the so-called critical pressure relation, the velocity of the discharge will be equal to the sound velocity. In most industries utilizing compressed air, the pressure normally present in the air supply network will be such, that the velocity of discharge, for example for cleaning purposes, using nozzles of the kind mentioned will be essentially equal to the sound velocity. Thus in most cases, the pressure relation will be equal to the critical pressure relation, i.e. 0.528.

When air is flowing out from an outlet in this manner under substantially adiabatic expansion there will occur a conically shaped core jet and outside of this a mixing zone where the air jet, due to transmission of movement to the ambient air in the form of expansion, will diverge and bring ambient air along with it in its movement. Thus, the air jet will increase in mass but will loose velocity. The loss of velocity entails that the dynamic pressure of the air jet will be partly transformed into static pressure. This pressure, added to the atmospheric pressure, comprises the counter pressure to which the pressure ratio is related.

The supply pressure at which critical flow occurs will thus be determined by the degree of co-ejection. From the point of view of co-ejection, among other things, it is an advantage to divide a given mass flow into several smaller part flows, so called multi-channel nozzles. This will provide, related to the mass flow amount, a considerably larger contact surface between outflowing air and ambient air, since the contact surface "KA" between outgoing flow and ambient air is directly proportional to the total circumference, $O_{out}$, i.e. $KA = O_{out} \times K$. K is a constant which is determined, among other things, by the angle at which the air jet diverges, i.e. by the conditions of turbulance, and by the distance between the nozzle outlet and the work piece to which the air jet is directed.

For instance, in the case of 10 outlet channels with a diameter of 1 mm, $O_{out} = 31.4$ mm, whereas, for the same outlet area $A_{out}$ using 1 outlet channel, $O_{out}$ is less than 10 mm. Thus, the contact number KT, which may be expressed as $O_{out}/A_{out}$, will be 4 mm/mm$^2$ and about 1.24 mm/mm$^2$, respectively. One drawback of multi-channel nozzles is the manufacturing of the long and narrow channel. An increased $O_{out}$, while maintaining the same $A_{out}$, to for instance 2 times 31.4 mm, i.e. to an increased KT of 8 mm/mm$^2$, will necessitate 40 channels with a diameter of 0.5 mm. Such a nozzle outlet, which gives a lower noise level, is difficult to implement in view of the manufacturing.

At the normal supply pressures of 6–8 bar there is obtained at larger nozzle outlets, preferably larger than 40 mm$^2$, a counter pressure which is lower than 0.528 times the supply pressure.

Within an outgoing air jet there will occur downstreams of the outlet local differences in velocity, pressure and density. The locally and periodically varying pressure differences will be reduced at a reduced outlet cross section. From the point of view of noise it is for instance known, that it is an advantage to divide a larger flow into several smaller and well distributed flows.

However, if the outlet channels in a multi-channel nozzle are placed too close to one another—for instance when there is a demand for larger mass flows—the atmospheric air will be prevented from communicating with the central portions within the generated jet bundle in a satisfying manner. Such communication is a prerequisite for, among other things, a low noise level in these nozzle embodiments.

Another common type of nozzle is the so called ejector nozzles which are commonly used for cooling, drying, and above all to blow away smoke or exhaust gases. The ejector nozzles, for instance in accordance with the Swedish patent specification SE.A. No. 8000567-1, operate by co-ejection via the central portions of the nozzle and remove smoke or exhaust gases from for instance a welding work place. The outgoing flow has a low power concentration and is strongly turbulent. This is caused by the fact that the trough-flow area of the common central outlet is much larger and by the fact that the friction losses within the outlet channel are extremely high. The frequencies spectrum of the resultant noize differs markedly from conventional blow nozzles.

For instance, it is known that pressurized outflowing gas gives a dominant noise generation at the so called Strouhal frequency, fs, which is determined by the relation $SN \times u/d$, where SN = The Strouhal number which at a Reynold's number of $>500$ is equal to 0.2 (dim. less)

u = outflow velocity, m/s d = cross-sectional dimension (s), m

For instance, in a circular outlet with an outlet diameter of 10 mm, there will be obtained, at normal critical outflow of air, a dominant noise generation within the frequency range of 6–7 kHz. At lower outlet velocities, for instance in ejector nozzles, a dominant noise generation will occur at substantially lower frequencies. With the outlet dimensions normally present in ejector nozzles, 10–75 mm, the dominant noise generation is at frequencies which are especially damaging to the human ear, or from about 4 kHz at the smaller outlet dimensions to about 1 kHz at the larger outlet dimension.

If, in an annularly shaped slit orifice, the ratio between the velocity of flow and the slit width is sufficiently large, dominant noise generation occurring at the outlet may be displaced to higher frequencies which are outside the range of frequency audible to humans. However, the vacuum generated in the central portions of the air jet will give rise to such a turbulent flow, that minimizing of the slit will not result in any substantial noise reduction in the surrounding area of these types of nozzles. Filling up a vacuum space with a solid body, for instance in accordance with the U.S. Pat. No. 3,984,054 does not result in any substantial improvements with regard to the noise.

The commerically available blow nozzles differ widely as concerns the blowing power. Since furthermore the need of blowing power varies considerably from one work place to another, and also within one and the same work place, and since neither the conventional nozzles and complete blowing tools are possible to regulate, nor are provided with information about the blowing power, the purchase and installation of such blowing devices involves many problems. The consequence is that the blowing devices will mostly have a too large capacity. Thus in most cases the air consumption, the noise and the risk of injury will be unnecessarily high.

A blowing tool of conventional type has a valve or regulation arrangement the blow-through area of which is substantially directly proportional to the displacement of the valve or regulator element. Since the blow-through amount at the outlet is a function of the area ratio between the blow-through areas at the valve and at the outlet, and since this function is very unlinear, the possibility of a control regulation of the amount of flow will be limited.

Displacement of the valve body from the closed position only a few tenths of a millimeter results in multiple changes of the amount of flow through the blowing device. On the other hand, a corresponding valve displacement at a position of larger opening will only result in percent changes of the amount of flow.

In the often reccuring work of blowing away dirt form machines, manufactured parts etc., additional noise is caused when the flowing gas hits the object to be cleaned. When cleaning so called bottom holes, a noise situation occurs which is completely dominated by the generation of sound at the hole. This type of work, which is mostly performed manually, gives rize to sound levels which at a distance of one meter generally exeeds 100 dB(A). The work also causes chips and cutting fluid to be squirted around. Such squirting of chips and cutting fluid causes a lot of eye injuries to the user as well as to persons in the vicinity.

The noise as well as the risk of squirting around chips may be reduced a certain amount by the aid of previously known technics, for example according to the German Pat. No. 2,908,004. However, this type of design has the considerable drawback that the gas fluid exiting from the centrally located exhaust tube will often obtain a hit zone which is outside of the hole to be blown clean. The operator therefore has to move the nozzle, by means of sweeping movements, to a position where the outflow of gas from the exhaust tube is located directly above the hole. The smaller the hole is, the longer time is needed for finding the correct position. Furthermore, such sweeping movements also entails that the operator will momentarily raise the plane of the nozzle from the object to be cleaned in order to reduce the friction between the end of the nozzle which mostly is made of rubber, and the object. The flow of gas through the slot thereby formed results in very high noise levels and, in certain cases, severe squirting of cutting fluid.

The drawbacks mentioned may be reduced if the exhaust tube is placed outside of the nozzle plane. However, this placement causes the exhaust tube as well as the object to be cleaned to be subjected to mechanical abrasion. The abrasion of the exhaust tube is especially high in connection with threaded hole configurations. In most manufacturing processes no mechanical abrasion, i.e. scratches, on the manufactured part are acceptable. Another drawback with an exhaust tube projecting from the nozzle is that this design is not usable at smaller hole diameters. In a threaded bottom hole, as an example, the diameter of the hole generally has to be larger than 6 mm.

A very important inconvenience in the cleaning of bottom holes according to the technic mentioned is the absence of an extensive regulation of the amount of stream. Different hole depths, hole configurations, cutting fluids etc. give rise to greatly different requirements as concerns the blowing power.

BRIEF SUMMARY OF THE INVENTION

The object of the invention is to provide a blowing nozzle which, related to the outlet area has a large contact surface between outflowing pressurized air and surrounding air for the purpose of obtaining an airflow with a low sound level, a large momentum, high efficiency and reduced striking velocity against the object to be cooled, dried or blown clean. In the latter case, it is of special importance to obtain a low sound level. In the basic concept the nozzle should be simple and inexpensive to manufacture and should be capable of forming the base of a manually portable blowing tool. Independently of whether the nozzle is used as a stationary or portable tool, the nozzle should be capable of being provided with a simple device for a well defined, substantially linear regulation of the mass flow amount through the nozzle. When the nozzle is used as a hand tool it should be capable of being converted, by simple hand movements, to a blowing tool which when used for cleaning holes, grooves etc., gives a low sound level and also the necessary protection against squirting around of chips and fluid. The basic concept should be capable of being modified to a nozzle at which there is present at least one further outflow substantially in the shape of a ring, or a part of a ring, to which outflow the surrounding air may be admixed to a substantial degree, externally peripherally as well as internally peripherally. These objects have been solved in that the product of, on the one hand, the ratio between the outer plus the inner circumference of the outlet and its outlet area, and on the other hand the ratio between the inner diameter of the outlet and its transverse dimension (i.e. the slot width S), is at least 4 $mm/mm^2$, preferably considerably larger than 4 $mm/mm^2$.

DETAILED DESCRIPTION

Figure 1:
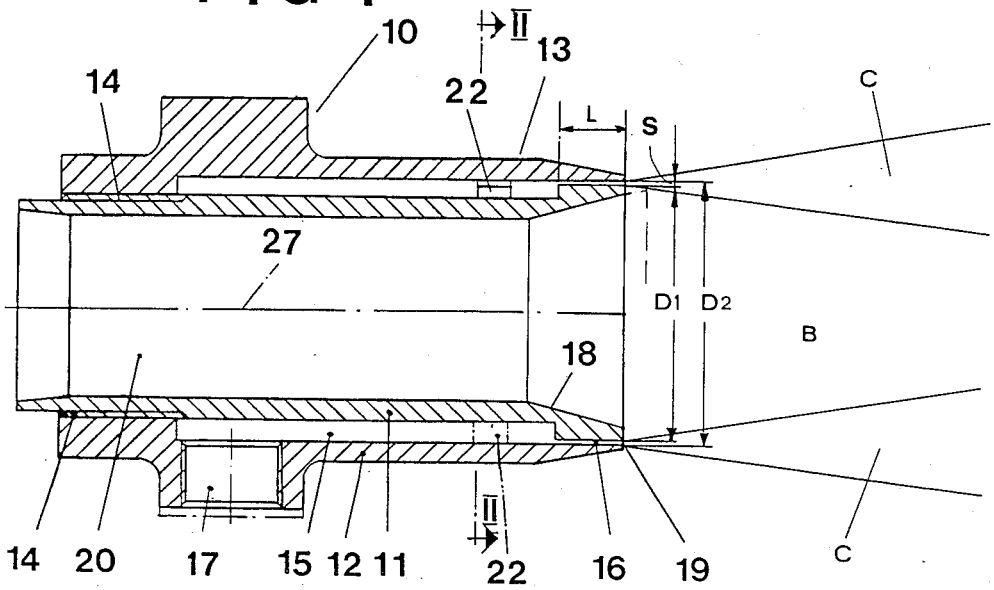
FIG. 1 is an longitudinal cross-sectional view through a blowing device according to a first embodiment of the invention and intended preferably to be used for stationary installations.
Figure 2:
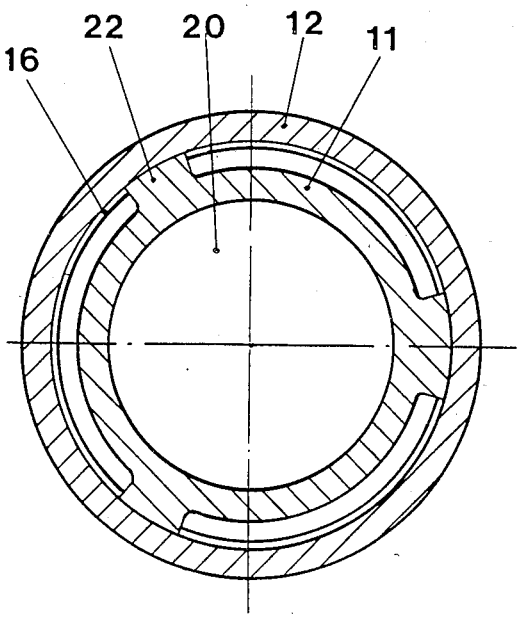
FIG. 2 is a cross-sectional view on to a larger scale taken along the line II—II in FIG. 1.

The simplest embodiment of a "silent" nozzle for a blowing device 10 according to the invention consists of an inner sleeve 11 and an outer sleeve 12, according to FIGS. 1 and 2. The two sleeves may by themselves together constitute a complete nozzle 13, preferably intended to be used in stationary installations. By means of a permanent connection, i.e. a screw connection 14, the sleeves are interconnected, at their rear ends, to form a unit in such a manner, that there is formed, between the sleeves 11, 12, an annular space 15 which serves as a supply channel for the compressed air. At the front end of the unit there is provided an outlet channel in the form of a substantially annular slot 16.

The blowing device 10 further comprises a connection 17 for the compressed air to the supply channel 15 and an outlet opening 18 in the inner sleeve 11. The outlet opening does not necessarily have to be conical as shown in the drawing.

When compressed air is supplied to the nozzle 13 through the connection 17, an annular jet C will be obtained at the outlet opening 19 of the slot 16. At the outlet opening, bound heat is transformed into kinetic energy under simultaneous expansion of the gas. A nozzle according to the invention is intended to be used for such types of work where the air pressure connected to the nozzle preferably is larger than 4 bar, i.e. the outflow from the outflow opening 19 is mainly in the form of critical flow.

The object of the invention is attained with the nozzle embodiments according to the following descriptions.

If in FIG. 1 the outer and inner diameters, respectively, of the sleeves 11, 12 at the outlet opening 19 is designated by D1 and D2, respectively, then D2−D1=twice the slot width S. In order to obtain a large contact surface between the outflowing gas or air and the surrounding air the nozzle according to the invention is provided with at least one communicating channel 20, i.e. in this way co-ejection is made possible outwardly peripherally as well as inwardly peripherally of the substantially annular flow.

In order to, in accordance with among other things one of the objects of the invention, delay the occurrence of the outgoing, substantially annular flow downstream of the outlet being integrated into a common flow with a large cross-sectional area with high velocity, the nozzle according to the invention has a cross-sectional ratio TF=D1/S which is larger than 3, preferably larger than 6. This is in order that the ratio between the total outlet circumference $O_{out}$ and the total outlet area $A_{out}$, comprising the contact number KT, multiplied with the cross-sectional ratio TF, together comprising a capacity number ET, will be substantially larger than 4 mm/mm$^2$, preferably substantially larger than 10 mm/mm$^2$. Thus, referring to FIG. 1, the relation 4 $(D2+D1)/D2^2-D1^2)$ times the relation D1/S should be considerably larger than 4 mm/mm$^2$ but preferably substantially larger than 10 mm/mm.

The indicated lower limit for the capacity number ET if "substantially larger than 4 mm/mm$^2$" is based upon the fact that dominant sound generation will thereby be displaced to higher frequencies which, in comparison with a conventional cylindrical tube outlet with the same blowing power, corresponds to a frequency displacement of about one octave.

Hereby is obtained a sound pressure reduction which at the standardized middle frequency with a frequency width of one octave at 4 kHz will be about 2 dB and at the standardized middle frequencies 8 and 16 kHz, respectively, will be about 3 dB.

This will cause a reduction of the dB(A)-filtered sound level of about 3 dB(A), i.e. at a capacity number of about 4 mm/mm$^2$ will be obtained a lowering of the sound level which largely corresponds to the lowering which is necessary for a human being to subjectively notice the lowering of the sound level.

Thus, the purpose of designing a blowing device with a capacity number of about 4 mm/mm$^2$ is that when a working blowing device is put up beside a working tubular nozzle, the blowing device according to the invention should be noticed as the decidedly more silent of the two.

In blowing devices with a plurality of substantially part ring shaped slot outlets where the individual outlet may have different slot diameters corresponding to the diameter D1, FIG. 1 the diameter D1 according to the above will be defined as a mean value of the inner slot diameters of all the partial outlets.

The slot S according to the above is defined as the mean value of the slot S computed over the actual number of slot outlets.

At the normally occuring mass flow amounts for the most common forms of cleaning, the mean value computed slot S should be smaller than 3 mm, preferably smaller than 1.5 mm. This is in order that dominant sound generation from the outlet will be found at frequencies higher than 20 kHz.

The acoustical advantages of the nozzle described obtained, among other things, is achieved by the unavoidable turbulency whereas in the stream flow C being limited to their largeness.

High co-ejection due to a large contact surface between outflowing air and surrounding air entails a rapidly decreasing velocity of flow but an increase in momentum.

Thus the increased co-ejection means that the airstream will reach the work object in question with a lower velocity and a higher mass flow. This means that a nozzle according to the invention, in contrast to the so called noise absorptive blow nozzles, has a substantially lower noise even when it is used as a working blowing tool.

Tests performed with nozzles substantially corresponding to the description herein above have been compared to most of the blow nozzles according to known embodiments. In all cases, a lower sound level and mostly markedly higher efficiency where noted while maintaining high blowing power. Compared to the more usual tube nozzles there is obtained, already at such a low value of the capacity number ET as about 4 $mm/mm^2$, a sound generation which is more than halved. The reduction of sound level will thereby be at least 3 DB(A). With a capacity number ET of about 10 $mm/mm^2$, the sound generation may be reduced to at least one third. At considerably higher values of the capacity number, very noticable reductions in sound level have been noted. With a capacity number ET of about 500 $mm/mm^2$ the sound generation may for instance be reduced to less than one tenth, and with a capacity number of about 5.900 $mm/mm^2$ up to one hundredth of the sound generation in traditional tube nozzles with the same amount of mass flow and/or blowing power.

Thus, the comprehensive tests have shown that, compared to a tubural nozzle with the same outlet area, a noise reduction in dB(A) is obtained which, at critical flow, is substantially proportional to 5 times the 10-logarithm for the capacity number ET.

Since, from the point of view of sound, it is of importance that the inner diameter D2 of the outer sleeve 12 is substantially concentric with the mantle surface of the inner sleeve 11, spacing elements 22 centering the sleeves relative to one another are provided on one or both of the sleeves.

Figure 3:
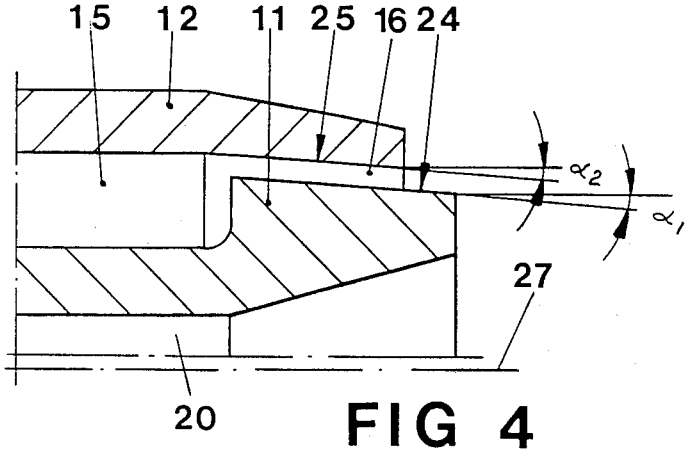
FIG. 3 is an enlarged longitudinal cross-sectional view of a portion of a nozzle outlet accoring to an alternative embodiment of the invention.
Figure 5:
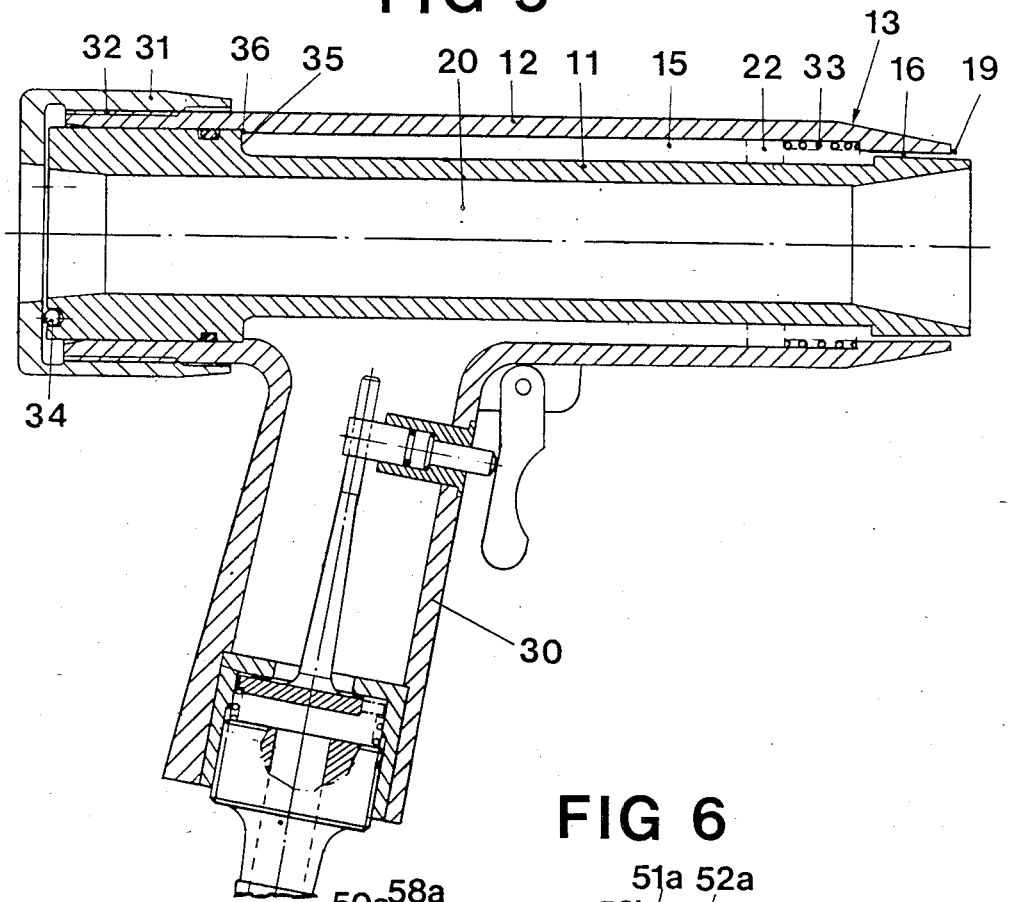
FIG. 5 is a longitudinal cross-sectional view through a complete blowing tool according to the first embodiment of the invention.

When the nozzle lacks the regulation possibility, according to FIGS. 3 and 5, while maintaining the advantages of the nozzle the corresponding spacing elements may be disposed in the annular slot 16 which may then be made with axial grooves, where the upper edges of the grooves abut against the inner side of the outer sleeve 12, or vice versa, the grooves may be provided at the inner side of the outer sleeve 12 and abut against the inner sleeve 11.

Thus, the annular outflow may not be completely cylindrical, but the flow may be divided in a number of flows shaped as a part of a ring. Also, these need not necessarily be situated along a common division diameter.

In order to reduce the possibility of the pressure variations occurring within the supply channel 15 from affecting the pressure situation at the outlet 19, the annular slot 16 should be longer than 4 times the slot width.

Figure 4:
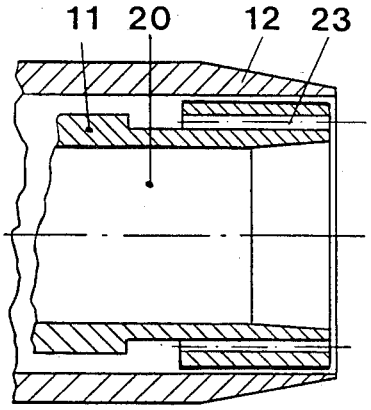
FIG. 4 is a cross-sectional view through a modified nozzle having circular outlet channels in addition to the annular slot.

When creating extremely high blowing powers per surface unit, for instance when blowing away parts from automatic machines, it may be of advantage, from the point of view of noise, to provide a number of substantially circular flow-through channels 23, according to FIG. 4 within the nozzle portion of the inner sleeve 11, instead of increasing the slot width S. The circular outlet channels 23 should be smaller than 2 mm, preferably smaller than 1.7 mm, and should be placed at a distance relative to each other which is larger than 2 times their diameter.

If a blowing device 10 is desired which is to allow a regulation of the amount of flow of air, the nozzle and the blowing device 10 are made according to the embodiment of FIGS. 3 and 5. By the aid of a regulated nut 31 which cooperates with threads 32 at the rear end of the outer sleeve 12 the inner sleeve 11 may be axially displaced against the action of a spring 33.

When the two sleeves 11 and 12, respectively, are displaced in relation to each other the slot width S will be increased or alternatively decreased. A precondition for making this possible is that the substantially circular surfaces 24 and 25 which delimit the annular slot 16 are angled in relation to the longitudinal axes 27 of the nozzle, see FIG. 3. The angles $\alpha 1$ or $\alpha 2$ should be less than 10°, preferably less than 2°. The angles need not necessarily be of the same size. Furthermore, the angles may be negative, i.e. the surfaces 23 and 24 may, relative to the direction of flow, be converging relative to the longitudinal axes 27 of the nozzle. The amount of air through one and the same may in this way be regulated within very wide limits. Furthermore, the regulation is substantially linear. The outer and the inner sleeve, respectively may advantageously be provided with markings 39 indicating the size of the blowing power (see FIG. 8).

In the embodiment according to FIG. 5, the outer sleeve of the blowing device 10 consitutes a portion of the base 30 of the device. The regulator nut 31 is screwed onto the rear portion of the base, and in order to reduce the friction of movement between the inner sleeve 11 and the regulator nut 31, one or several roller or ball elements 34 are provided within the rear end plane of the inner sleeve.

In the drawing position shown the inner sleeve has its front position within the base 30, i.e. the shoulder 35 of the inner sleeve bears against the shoulder 36 on the base.

Figure 6:
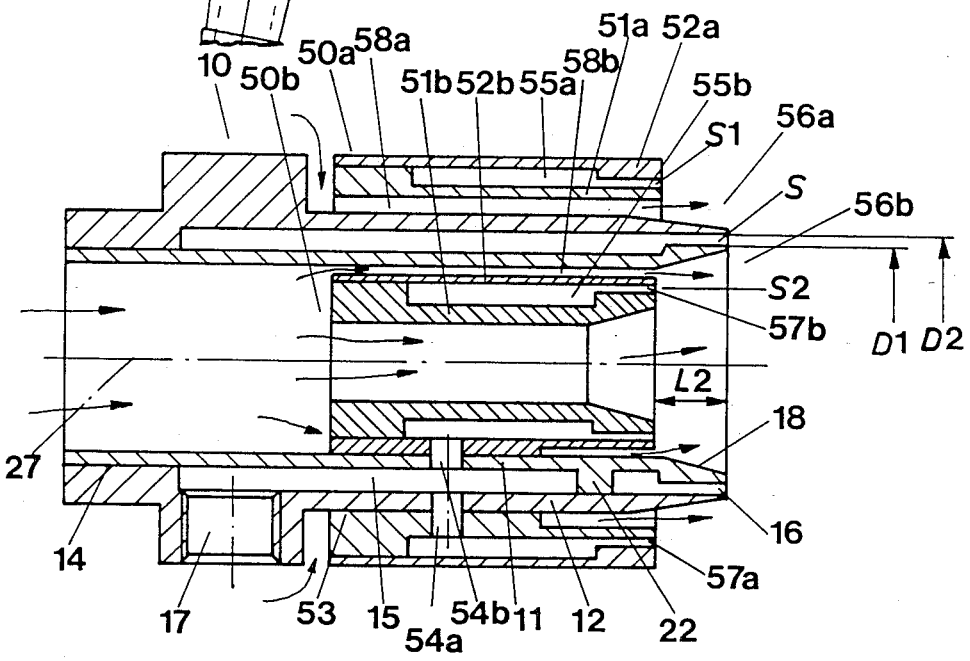
FIG. 6 is a longitudinal cross-sectional view through a further embodiment of a nozzle according to the invention.

For preferably higher needs of blowing power it is of advantage to subdivide a ring shaped, or part-ring shaped, flow into one or several further substantially ring and/or part-ring shaped flows where the inner and outer limiting surfaces of the respective flows have the possibility of co-ejection—for instance as in the nozzle according to FIG. 6. Wherein the co-ejection routes are indicated with arrows.

Thereby, the increase in the capacity number ET may be multiplied while maintaining the total outlet areas $A_{ut}$ because the slot width S for the respective part flows will then be more than halved. Dominant sound generation will be displaced to still higher frequencies because the frequency with which dominant sound generation occurs is inversely proportional to the slot width S of the air flow.

Furthermore, with correctly controlled outflows as regards pressure, density and velocity, the embodiment with an increased number of outlets will give the possibility of further sound reductions relative to the amount of mass flow present. Further, by the aid of at least one substantial annular additional flow in the surrounding area around a mainflow, the latter may be imparted with over-critical flow the radiated higher sound effect of which will interfere to substantially with pressure pulses present within surrounding additional flows.

The embodiment according to FIG. 6 may be an addition to the blowing device 10 according to FIG. 1. In a first step the blowing device 10 may be provided with an outer nozzle part **50*a* which consists of two cylindral sleeves 51*a* and 52*a*. The inner sleeve 51*a* is connected, by means of a pressfit, a groove or screw connection, via the spacer elements 53, with the outer sleeve 12 of the blowing device 10**.

The spacer elements 53 are shaped in accordance with the same principle as the spacers 22 in FIG. 1.

Within at least one spacer element 53 there is a flow-through passage 54*a* which is supplied with pressurized air from the supply channel 15 and conducts it to the chamber 55*a*.

The space 56*a* between the two nozzle outlets 19 and 57*a*, respectively, communicate with the surrounding area via a substantially annular communication channel 58*a*.

As a second step, the blowing tool 10 may advantageously be provided with an inner nozzle part 50*b*. As shown in FIG. 6, this made be shaped substantially at the outer nozzle part 50*a*.

With a nozzle embodiment having at least two annularly shaped partial flows, the surrounded flow-through nozzle 13 will obtain, with adjustment of the amount of mass flow for the surrounding flows from the outlets 57*a* and/or 57*b*, a counter pressure downstream of the outlet which is substantially lower than the critical pressure. That is, the counter pressure downstream of the outlet 19 may be made less than 0.528 times the supply pressure connected to the blowing device 10.

Figure 7:
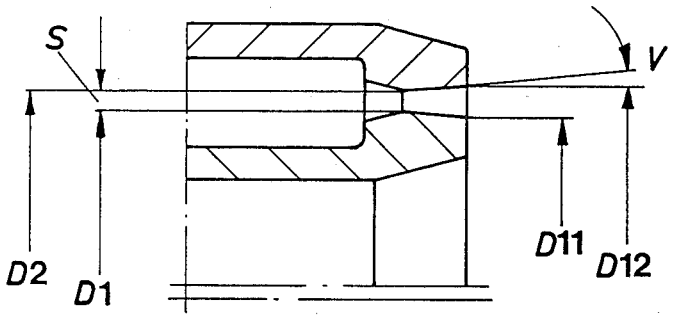
FIG. 7 is an enlarged longitudinal cross-sectional view through a portion of a nozzle outlet according to the embodiment of FIG. 6.

The annular nozzle outlet 19 (FIG. 7) is adjusted to give over-critical outflow at the outlet 19 of the blowing device 10. In order to reach an over-critical flow at the outlet 19, the capacity number ET in this embodiment should be at least 20 $mm/mm^2$, preferably larger than 100 $mm/mm^2$. Further, the relation between $D12^2-D11^2=G$ and $D2^2-D1^2=H$ should be less than 1.7 at an available supply pressure of 8 bar. At an available supply pressure of 6 bar, G/H should be less than 1.45. The latter entails a velocity increase by a factor of 1.55. The angle V should be 3°–6°.

Available velocity increases for the outlet 19 will allow savings of air by 20–30% while maintaining blowing power.

Acoustically achieved advantages with the over-critical flow mentioned is that for a given mass flow and/or blowing power the outlet velocity will increase when the slot width S is reduced. Dominant sound generation may thereby be displaced to even higher frequencies, because the frequency at which dominant sound generation occurs is directly proportional to the velocity of the airflow and inversely proportional to the slot width S of the airflow.

Figure 8:
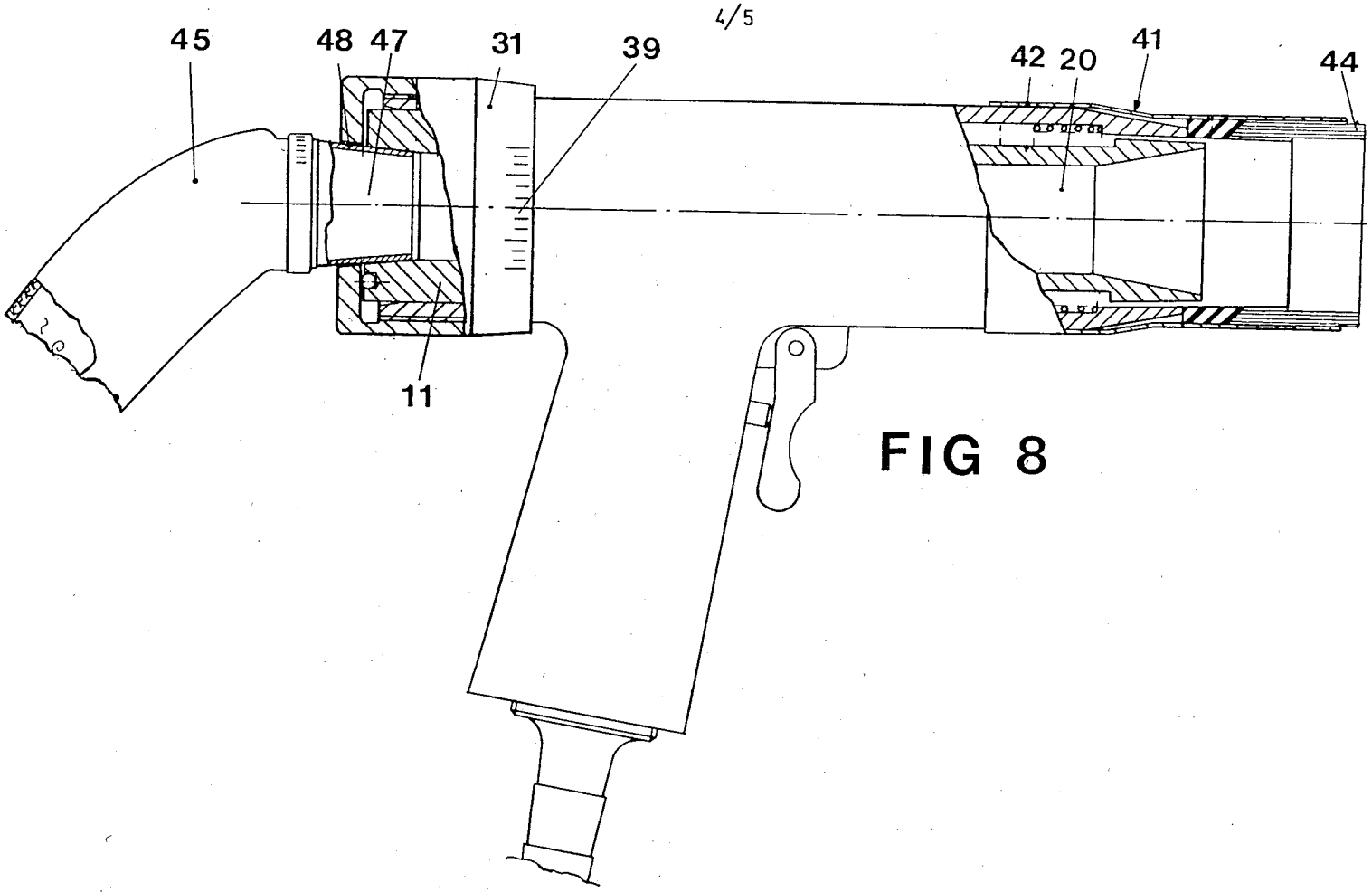
FIG. 8 is an elevational partly cut away view of the blowing tool according to FIG. 5 with additional devices according to the invention intended to be used preferably in the cleaning of so called bottom holes.

The blowing device according to FIG. 5 may be converted into a blowing tool for cleaning so called bottom holes as shown in FIG. 8.

To the nozzle end 13 of the blowing device there is connectable a protective collar 41 consisting of a thin-walled tube of plastic or sheet metal and provided with a brush element 44 intended to be placed against an object to be blown clean, for instance a hole. Since the resistance against flow in the brush element is considerably larger than the resistance against flow in the communicating channel 20, the cleaning air will be evacuated through said channel. The brush element 44 may of course be replaced with some other flexible material such as foamed plastic or foulded rubber. By connecting the communicating channel 20 to a collecting device 45, i.e. to a central service suction conduit, alternatively to a collecting bag, (not shown) which, for instance by means of an insertion tube 47 is connected to a conical seat 48 in the inner sleeve 11, large reductions in sound level are obtained.

Tests that have been made have shown that a blowing tool substantially corresponding to FIG. 8 will reduce the momentarily occuring sound peaks with more than 20 dB(A), whereby, the amount of noise during a typical working day may be reduced by 7–10 dB(A). The nozzle gives an airflow with an impact surface substantially corresponding to the diameter of the brush element 44. Thus, the blowing operation may be started directly after the brush element has been placed above the hole to be blown clean, whereby uncontrolled squirting of chips and cutting fluid will be eliminated. Furthermore, there will be no risk for mechanical abrasion on the blowing tool or the object to be blown clean.

Figure 9:
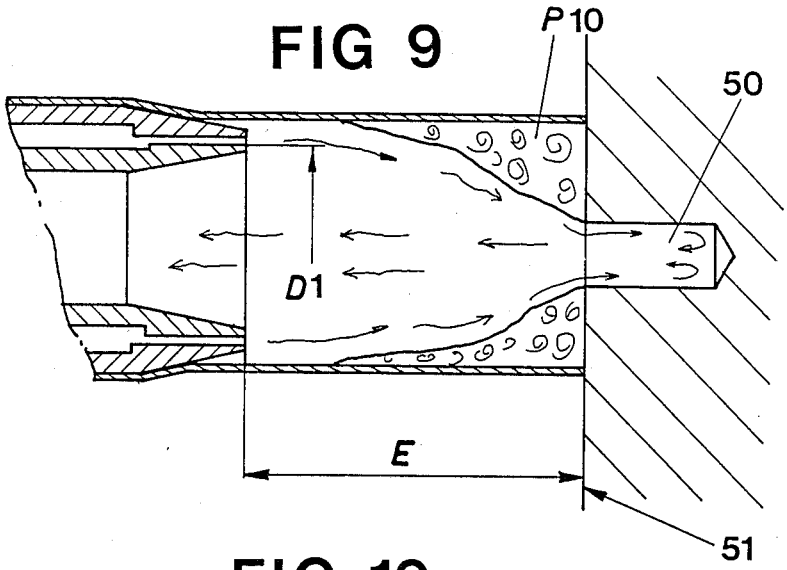
FIG. 9 illustrates diagrammatically the operation of a blowing tool of the embodiment according to FIG. 8.

Tests which have been made have shown that when the overhang E is well adapted in relation to the diameter D1 of the outlet channel 16, a flow picture is obtained which is illustrated diagrammatically in FIG. 9.

Within the zone P10 there will be formed a turbulent air cushion which is at rest in relation to the air stream and which has a higher static pressure and guides the flow to the hole 15 to be blown clean.

Figure 10:
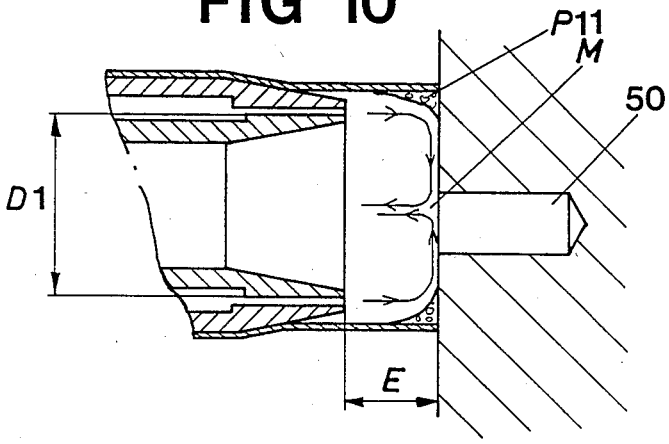
FIG. 10 illustrates diagrammatically how the operation of a blowing tool according to FIG. 8 is affected by a disadvantageous relation between the overhang E and the diameter D1.

When the overhang is too small, as diagrammatically illustrated in FIG. 10, a flow picture is obtained which does not have the ability of cleaning the hole 50. That is, a small measure E and the small air cushion P11 will cause a direction of movement which very much diverges from the optimum direction of movement for cleaning. It should also be pointed out that a too large overhang E gives a deteriorated blowing clean function. However, in this case, the divergence from the optimum working function may be compensated to a certain extent by an increased mass flow through the blowing device.

Tests which have been made have shown that the clean blowing function is dependent upon the diameter D1 of the ring- or part-ring shaped outlet, the overhang E and the cross sectional and longitudinal dimensions of the hole 50.

Variations in hole dimensions may be compensated to a large degree by varying the mass flow through the blowing device.

Figure 11:
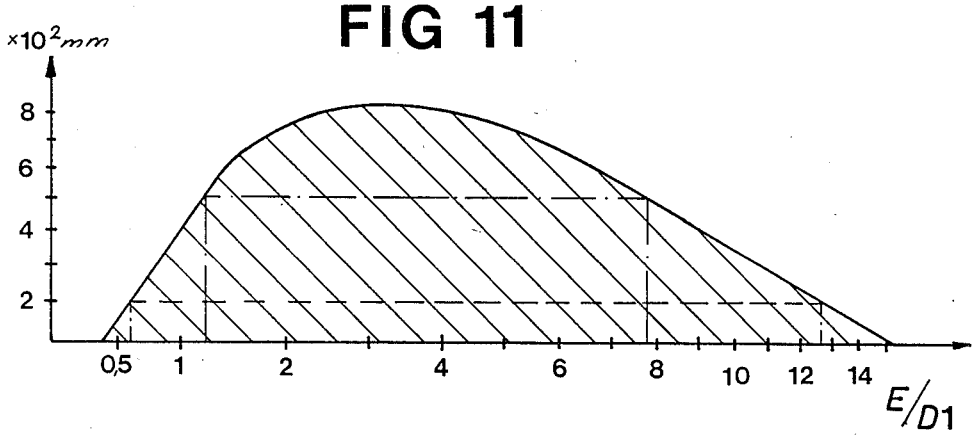
FIG. 11 is a graph showing the lifting capacity of a test body based upon the relation between the overhang E and the diameter D1 for a working blowing tool according to FIG. 8.

FIG. 11 illustrates how, in a test with one and the same amount of mass flow, the lifting height of a test body varies depending upon the ratio E/D1. Lifting height here means the distance between the plane 51 of the work object and a reference plane which is placed behind which is positioned in the vertical plane. The test body which was placed in the bottom of a hole standing in the vertical plane (here with the diameter 10 mm and the depth of the hole about 30 mm) was thus distributed via the communication channel 20 of the blowing device and thereafter via the atmosphere to the reference plane. The distance of the reference plane to the plane 51 was adjusted so that the test body could hit the same with a slight margin.

In order to obtain a sufficiently good work function for most different hole dimensions at the hole 50, the relation between the overhang E of the protective collar and the mean value inner diameter D1 for the ring or part-ring shaped outlet (S) should be greater than 0.6 and smaller than 12.7. However, preferably the relation should be greater than 1.2 and less than 8.

The communication channel 20 need not necessarily, as shown in FIG. 8, be consituted by a single channel. Further, the ring or part-ring shaped outlets 19 need not be constituted by slot-shaped channels 16, but the substantially ring or part-ring shaped flow within the protective collar 41 may be formed by an outlet consisting of a series of cylindrical channels, as the channels 23 in FIG. 4.

When the blowing tool is used in the manner described for the clean-blowing of holes, grooves etc. the essential of being able to continually regulate the blowing power will be more clearly apparent since the total pressure drop through the collecting bag (not shown) will vary with respect to the degree of filling, but above all, with respect to the fact that different hole shapes, types of cutting fluid, etc. demand different blowing power. A regulation may easily be provided by means of the fitting of the regulating means 31.

The invention is not limited to the embodiments shown and described but may be implemented in many other ways within the scope of the claims.

I claim:

1. A nozzle for a blowing device comprising:

an inner hollow cylindrical member;

an outer hollow cylindrical member at least partly surrounding said inner cylindrical member to form a nozzle at one end of said cylindrical members;

an open supply channel between said cylindrical members having an outlet with inner and outer circumferences at said nozzle end for compressed air supplied to said channel to produce a jet of air in the form of at least a part of a ring under adiabatic expansion;

a source of compressed air connectable to said supply channel;

at least one communication channel in said inner hollow cylindrical member having two ends open to the atmosphere, one of said ends comprising an outlet substantially concentrically surrounded by said supply channel outlet and operatively associated therewith to connect the inside of said jet with the atmosphere; and the product of the ratio of the sum of the inner and outer circumferences of said supply channel outlet to the cross-sectional area of said supply channel area and the ratio of the inner diameter to the width of said supply channel outlet being larger than 4 $mm/mm^2$.

2. A nozzle as claimed in claim 1 wherein said supply channel outlet comprises at least one annular slot having a narrow cross-section.

3. A nozzle as claimed in claim 1 wherein said supply channel outlet comprises at least one row of holes arranged in circular spaced relationship.

4. A nozzle as claimed in claim 2 wherein said width of said annular slot is less than 3 mm.

5. A nozzle as claimed in claim 2 wherein the width of said annular slot is less than 1 mm.

6. A nozzle as claimed in claim 2 and further comprising;

means to vary the width of said annular slot.

7. A nozzle as claimed in claim 2 wherein said annular slot diverges with respect to the longitudinal axis of the nozzle toward said supply channel outlet.

8. A nozzle as claimed in claim 2 wherein said annular slot converges with respect to the longitudinal axis of the nozzle toward said supply channel outlet.

9. A nozzle as claimed in claim 2 wherein said annular slot has a length at least four times the width thereof.

10. A nozzle as claimed in claim 9 wherein said length is greater than 15 times said width.

11. A nozzle as claimed in claim 2 wherein said cylindrical members are concentrically radially spaced inner and outer sleeves, and further comprising:

means operatively associated with said sleeves to displace said sleeves axially relative to each other, said annular slot being disposed between said sleeves.

12. A nozzle as claimed in claim 11 wherein the outer diameter of said inner sleeve and the inner diameter of said outer sleeve vary along the axial length of said annular slot so that said relative axial displacement of said sleeves varies the width of said slot.

13. A nozzle as claimed in claim 3 wherein the diameter of said holes is less than 2 mm.

14. A nozzle as claimed in claim 13 wherein the diameter of said holes is less than 1.7 mm.

15. A nozzle as claimed in claim 1 and further comprising:

a protective collar connected to the outlet end of the nozzle extending coaxially with and outwardly downstream from said outlet end; and a collecting means operatively connected to the other end of said communication channel;

the ratio of the length of said collar beyond the outlet end of the nozzle to the inner diameter of said supply channel outlet is larger than 0.6 but less than 12.7.

16. A nozzle as claimed in claim 15 wherein said supply channel outlet comprises at least one annular slot having a narrow cross-section.

17. A nozzle as claimed in claim 16 wherein the width of said annular slot is less than 3 mm.

18. A nozzle as claimed in claim 7 wherein said annular slot has a length at least four times the width thereof.

* * * * *